US006893243B2

(12) United States Patent
Maas et al.

(10) Patent No.: US 6,893,243 B2
(45) **Date of Patent: *May 17, 2005**

(54) DEVICE FOR MELT SPINNING AND COOLING A FILAMENT BUNDLE

(75) Inventors: Lutz Maas, Wahlstedt (DE); Holger Brandt, Ehndorf (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 142 days.

This patent is subject to a terminal disclaimer.

(21) Appl. No.: 10/072,144

(22) Filed: Feb. 7, 2002

(65) Prior Publication Data

US 2002/0119210 A1 Aug. 29, 2002

(30) Foreign Application Priority Data

Feb. 7, 2001 (DE) ..... 101 05 440

(51) Int. Cl.[7] ..... D01D 5/092; D01D 5/096

(52) U.S. Cl. ..... 425/72.2; 425/92; 425/94; 425/190

(58) Field of Search ..... 425/72.2, 90, 92, 425/94, 102, 182, 190, 192 R, 192 S, 464, 382.2

(56) References Cited

U.S. PATENT DOCUMENTS

| | | | | |
|---|---|---|---|---|
| 3,227,857 A | | 1/1966 | Hill, Jr. et al. | 219/469 |
| 3,612,170 A | | 10/1971 | Lyon | 165/89 |
| 4,038,357 A | * | 7/1977 | Boyes et al. | 264/168 |
| 5,421,070 A | | 6/1995 | Lenk | 28/240 |
| 5,536,157 A | * | 7/1996 | Linz | 425/72.2 |
| 5,624,593 A | | 4/1997 | Martens | 219/619 |
| 5,866,055 A | * | 2/1999 | Schwarz et al. | 264/103 |
| 6,062,838 A | * | 5/2000 | Glawion et al. | 425/72.2 |
| 6,174,474 B1 | * | 1/2001 | Stein et al. | 264/129 |
| 2003/0025239 A1 | * | 2/2003 | Brandt et al. | 264/211.14 |
| 2003/0039710 A1 | * | 2/2003 | Kropat et al. | 425/72.1 |

FOREIGN PATENT DOCUMENTS

| | | |
|---|---|---|
| CH | 557 902 | 1/1975 |
| DE | 26 39 458 B1 | 6/1977 |
| DE | 37 08 168 A1 | 9/1988 |
| DE | 195 40 905 A1 | 5/1996 |
| DE | 196 13 433 A1 | 12/1996 |
| DE | 196 53 451 A1 | 6/1998 |
| EP | 0 854 216 A1 | 1/1998 |
| EP | 0 957 187 A2 | 5/1999 |
| FR | 292809 | 11/1953 |
| JP | 08-296141 | 11/1996 |
| WO | WO 92/15732 | 9/1992 |

OTHER PUBLICATIONS

"Quenching System For Melt Spinning Plants", Chemical Fibers International (CFI) vol. 45, Oct. 1995.

* cited by examiner

*Primary Examiner*—Joseph S. Del Sole
(74) *Attorney, Agent, or Firm*—Kennedy Covington Lobdell & Hickman, LLP

(57) ABSTRACT

A device for melt extrusion spinning and cooling of a filament bundle comprises a spinning device with an annular spinning jet for extruding the filament bundle as well as a cooling device arranged below the spinning device. The cooling device comprises a holding device and a blowing chamber connected to the holding device. The blowing chamber is held in an operating position substantially centrally to the spinning jet in contact between the spinning device and the holding device. The blowing chamber can be axially displaced relative to the holding device between the operating position and a replacement position.

12 Claims, 4 Drawing Sheets

DEVICE FOR MELT SPINNING AND COOLING A FILAMENT BUNDLE

CROSS-REFERENCES TO RELATED APPLICATIONS

This application claims the benefit of German patent application DE 10105440.8 filed Feb. 7, 2001, herein incorporated by reference.

BACKGROUND OF THE INVENTION

The present invention relates to a device for melt extrusion spinning and cooling of a bundle of filaments and, more particularly, to such a device comprising a spinning device having an annular spinning jet and a cooling device arranged below the spinning device, wherein the cooling device comprises a blowing chamber for directing a coolant stream onto the filament bundle and a holding device for engaging the blowing chamber between the spinning device and the holding device in an operating position of the blowing chamber substantially centrally to the spinning jet.

During the melt spinning of synthetic yarns a plurality of strand-like filaments is extruded from a molten polymer by a spinning jet, sometimes referred to as a spinneret, having a plurality of jet bores. The filament strands exiting from the bores of the spinning jet must be cooled in order to be taken up after further treatment as yarns or yarn bundles. Preferably, the cooling medium is air directed to flow onto the filaments transversely to the direction of filament travel. The cooling air can penetrate the filament bundle from outwardly toward the inside of the bundle or from inwardly toward the outside of the bundle. An example of such known devices in which the current of cooling air penetrates a filament bundle from inwardly toward the outside of the filament bundle is disclosed in German Patent Publication DE 37 08 168A1.

In such known device, the filament bundle is produced by an annular spinning jet in a spinning device. A cooling device is provided below the spinning device, which cooling device comprises a blowing chamber aligned substantially centrally to the spinning jet. The blowing chamber is connected to a holding device by means of which a coolant is introduced into the blowing chamber. The blowing chamber is surrounded and defined by a porous annular jacket, e.g., comprised of a sintered material, so that the cooling air flowing into the interior of the blowing chamber exits radially outwardly through the porous jacket and passes through the filament bundle. Such devices have the basic problem that the volatile components of the filament bundle accumulate on the porous jacket of the blowing chamber making necessary from time to time a periodic cleaning or replacement of the blowing chamber. The known device has the further disadvantage that the complete cooling device must be removed from the spinning area for such cleaning or replacement.

The known device has the further problem that the extent of filament travel over which the filaments are cooled by the coolant air and the position of the downstream yarn preparation device are in a fixed relationship to one another and can not be changed.

SUMMARY OF THE INVENTION

It is accordingly an object of the present invention to provide a filament spinning and cooling device of the type described above with an adjustable cooling device that, on the one hand, makes possible replacement of a blowing chamber by a simple manipulation and, on the other hand, makes possible the selective adjusting of the yarn guidance.

The invention addresses this objective by providing a device for melt extrusion spinning and cooling of a filament bundle of the type that basically comprises a spinning device having an annular spinning jet and a cooling device arranged below the spinning device, wherein the cooling device has a blowing chamber for directing a coolant stream onto the filament bundle and a holding device for engaging the blowing chamber between the spinning device and the holding device in an operating position of the blowing chamber substantially centrally to the spinning jet.

The invention is distinguished in that the blowing chamber of the cooling device is displaceable in an axial direction relative to the holding device, which provides the capability of adjusting the blowing chamber between an operating position and a replacement position. The operating position is a position assumed by the blowing chamber during the cooling of the filament bundle. In contrast, the replacement position is a position of the blowing chamber displaced below the operating position in the direction of filament travel which replacement position makes it possible to replace the blowing chamber. The axial mobility of the blowing chamber has the particular advantage that the blowing chamber is held in the operating position independently of the relative position between the holding device and the spinning device. Therefore, even rather large deviations of tolerance during the positioning of the holding device can be readily compensated in an advantageous manner.

In order to replace the blowing chamber directly out of the cooling device positioned below the spinning device, the blowing chamber is connected according to an advantageous further development of the invention in a detachable manner to the holding device. Thus, in the replacement position the blowing chamber is removed from the holding device and re-mounted on the holding device after a cleaning or replacement or after the spinning start. The holding device with the supply lines for the coolant can be advantageously held in a stationary manner.

In an especially advantageous further development of the invention, the blowing chamber is urged toward and held in the operating position by a biasing device provided between the blowing chamber and the holding device. This arrangement assures that the blowing chamber is guided and held reliably in the operating position after each replacement.

The biasing device could be formed by electric, pneumatic or hydraulic means. However, the use of a pretensioned spring as the biasing device has the advantage that a constantly present guide force acts on the blowing chamber in the direction of the operating position. In this manner, a counterforce need be generated only in the case of performing a replacement or cleaning of the blowing chamber. The biasing device can advantageously be secured in the replacement position so that no undesired movement of the blowing chamber occurs.

In order on the one hand to reliably transfer the coolant to be introduced via the holding device into the blowing chamber and on the other hand to make possible an axial displacability of the blowing chamber relative to the holding device, the device in accordance with the invention is preferably designed in accordance with the further development of connecting the blowing chamber at its end facing the holding device to a tubular connection element. The holding device comprises a tubular receiving element for receiving the connection element, which connection element and receiving element are connected to one another by insertion of the connection element into the receiving element in such a manner that the connection element can move relative to the receiving element.

In this regard, a further development of the invention provides for detachable connection of the blowing chamber and the connection element which is especially advantageous for replacing the blowing chamber since the movement of the blowing chamber and the loosening of the blowing chamber can be performed independently of one another.

The biasing device embodied as a spring is preferably inserted into an annular space formed between the connection element and the receiving element and thus acts between the connection element and the receiving element.

According to an especially advantageous further development of the invention, several guide elements are provided for shifting, rotating and locking the connection element relative to the receiving element. This arrangement assures a centered adjustment of the blowing chamber relative to the holding device.

The holding device of the cooling device is preferably used to receive a preparation device attached below the blowing chamber to the holding device. The preparation device comprises a preparation ring that is contacted by the filament bundle and places a preparation agent on the filaments.

In order on the one hand to obtain a uniform moistening and distribution of the preparation agent on the surface of the preparation ring and on the other hand to assure a low-wear, reliable yarn guidance, the preparation ring is preferably formed from several ceramic disks.

According to a further development of the invention, the holding device is adjustable in elevation and/or rotationally relative to the spinning device, which is especially advantageous for enabling a fine adjustment of the position of the preparation device without changing the cooling path of travel for cooling the filaments. Thus, the interval between the spinning device and the preparation device can be adjusted by adjusting the height of the holding device independently of the position of the blowing chamber. This design is thus especially advantageous for setting a position that is favorable for the preparation of the filaments at the start of the process.

A few exemplary embodiments of the device of the invention are described in detail below with reference to the attached drawings

DETAILED DESCRIPTION OF THE PREFERRED EMBODIMENTS

Figure 1:
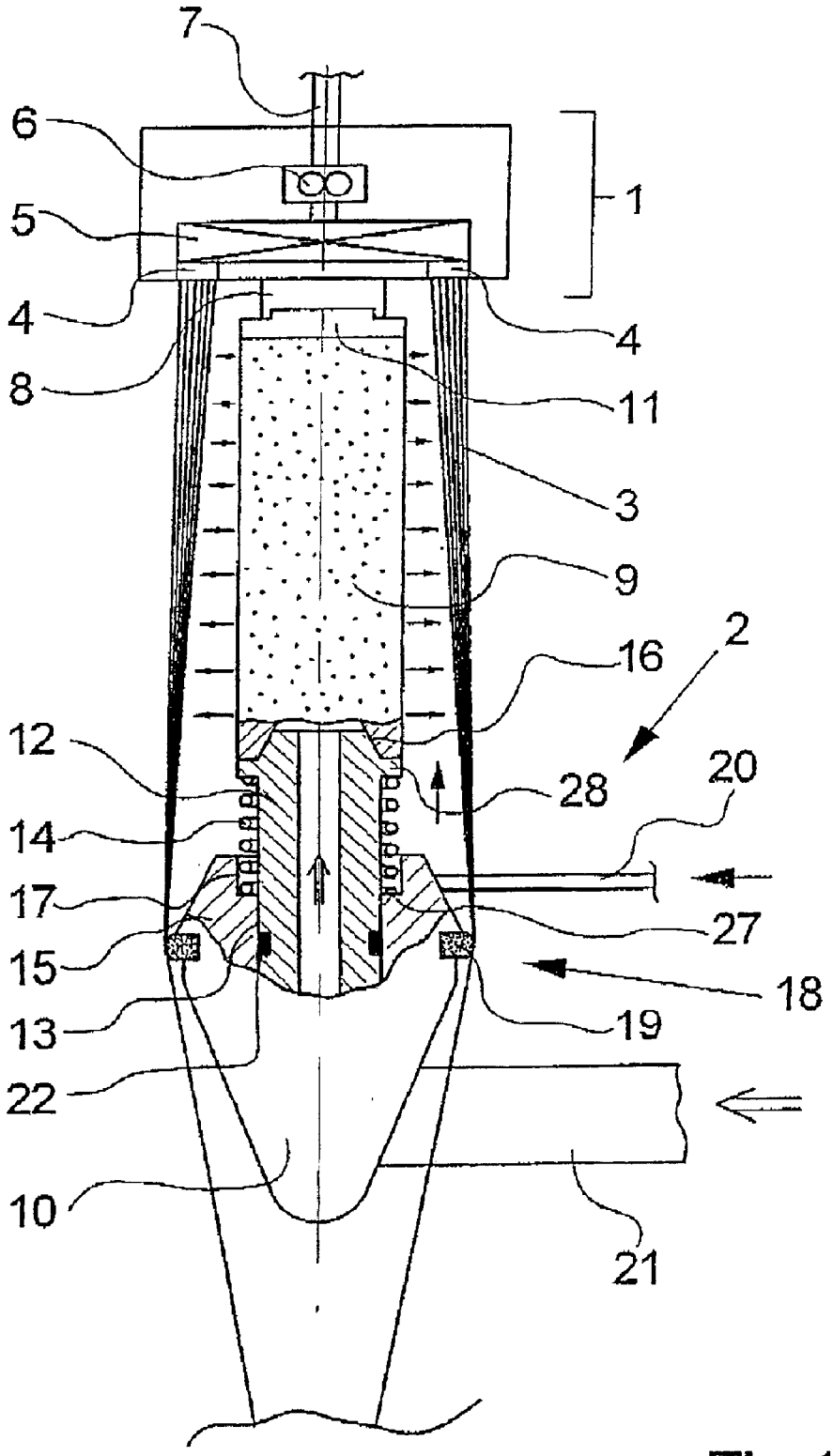
FIGS. 1 and 2 schematically show a first exemplary embodiment of the filament melt spinning and cooling device of the invention.
Figure 2:
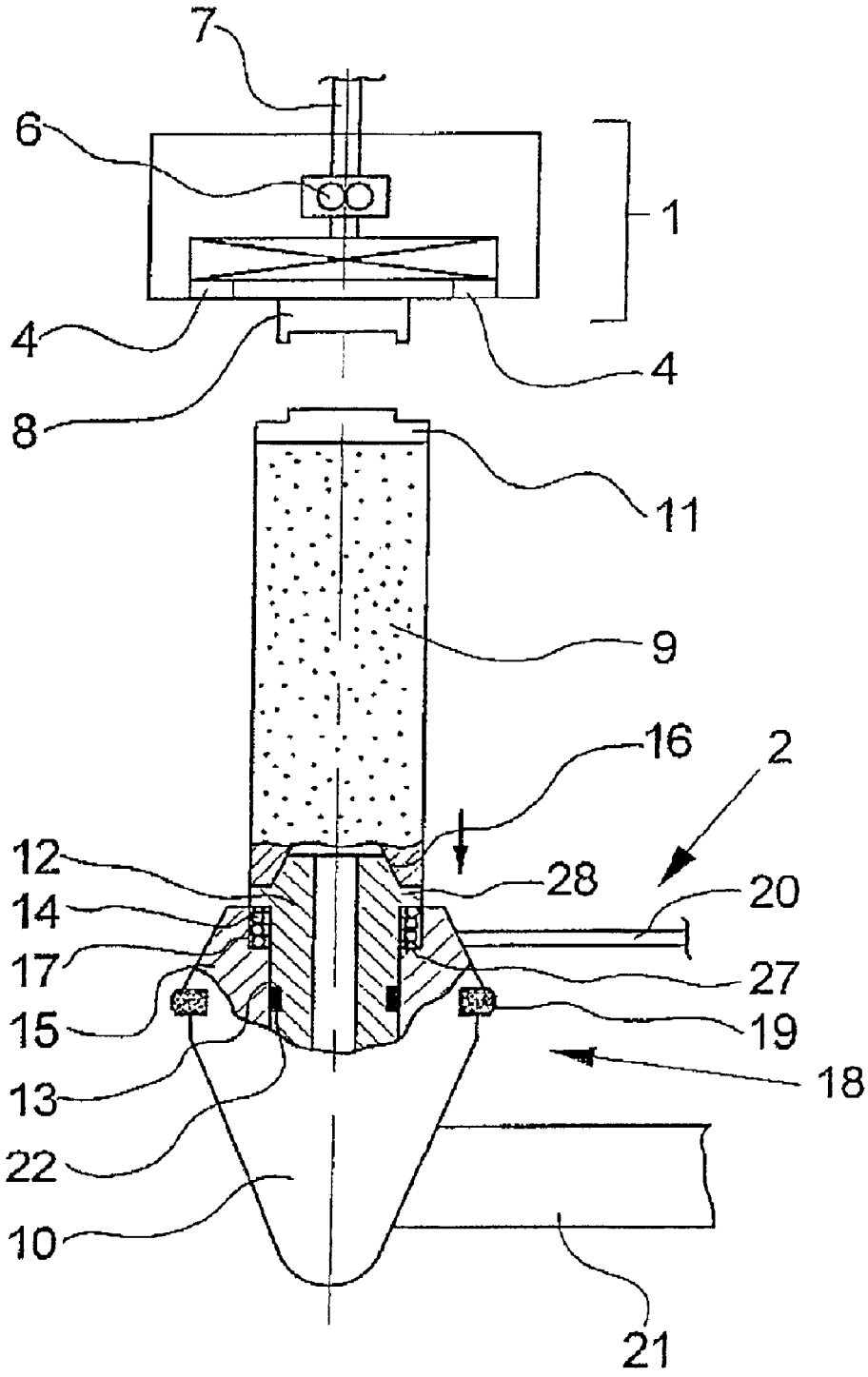

FIGS. 1 and 2 schematically show a first exemplary embodiment of a filament spinning and cooling device according to the present invention. FIG. 1 shows the device in operation and FIG. 2 shows the device out of operation. To the extent that no express reference is made to one of the figures, the following description applies to both figures.

The device is basically comprised of a spinning device 1 and a cooling device 2 arranged beneath spinning device 1. Spinning device 1 comprises annular spinning jet 4 disposed on a lower downwardly facing side of the spinning device which jet communicates via melt distributor 5 with spinning pump 6. Spinning pump 6 communicates via melt line 7 with a source for producing and supplying molten polymer (not shown).

Cooling device 2 beneath spinning device 1 comprises holding device 10 and blowing chamber 9 connected to holding device 10. Blowing chamber 9 has a porous annular jacket that can be manufactured, e.g., of a fleece, foamed material sieve fabric or a sintered material. Blowing chamber 9 is closed at its upper free end by centering attachment 11.

Blowing chamber 9 comprises connection element 12 on the opposite end of blowing chamber 9 facing holding device 10. Connection element 12 and blowing chamber 9 are connected to one another by conical seat 16. Connection element 12 is a tubular hollow cylinder in design and forms an axial prolongation of blowing chamber 9. Connection element 12 is inserted by its lower free end into receiving element 15 of holding device 10, which end of the connection element 12 is guided in a sliding manner within centering opening 13 of receiving element 15. Seal 22 is provided on the circumferential surface of the guided end portion of connection element 12. Connection element 12 communicates with a pressure chamber inside holding device 10, which pressure chamber in turn communicates via feed line 21 with a pressure source.

Annular recess 17 is formed on the end of receiving element 15 facing the blowing chamber between receiving element 15 and connection element 12. The spring or other form of biasing element 14 designed is arranged in this annular space. Spring 14 is tensioned between collar 28 of connection element 12 and step 27 within recess 17 of receiving element 15.

Preparation device 18 is provided on the circumference of holding device 10 and comprises preparation ring 19 set on holding device 10. Preparation ring 19 is supplied from within with a preparation liquid supplied via line 20.

FIG. 1 shows the spinning device and cooling device in operation, wherein blowing chamber 9 is held by spring 14 and connection element 12 in an operating position. Centering attachment 11 of blowing chamber 9 rests thereby on stop 8 of spinning device 1. Stop 8 is arranged on the bottom of spinning device 1 substantially centrally to spinning jet 4.

A coolant, preferably cool air, is supplied in the operating position via feed line 21 into a pressure chamber formed inside the holding device. The coolant is conducted via the pressure chamber and via hollow cylindrical connection element 12 into the inside of blowing chamber 9. The coolant then passes uniformly radially outwardly through the jacket of blowing chamber 9 and penetrates and passes outwardly through filament bundle 3 produced by spinning jet 4. After the filaments of filament bundle 3 have been cooled, the filaments are prepared for subsequent operations by preparation device 18 wherein a preparation agent is conducted via line 20 to preparation ring 19. Preparation ring 19 may be manufactured, e.g., from a porous material so that the preparation agent is distributed uniformly in preparation ring 19 and exits on the surface in order to prepare the filaments. After the preparation the filament bundle is ready for further treatment. For example, the filament bundle could be conducted and wound as yarns in this manner or combined to a yarn bundle and deposited in a can.

FIG. 2 shows the device of the invention out of operation. Blowing chamber 9 of cooling device 2 is displaced downwardly away from the spinning jet 4 into a replacement position by thrusting blowing chamber 9 with connection element 12 axially in the direction of yam travel against spring 14. Centering attachment 11 of blowing chamber 9 separates thereby from stop 8 of spinning device 1. Connection element 12 can be locked in the replacement position on receiving element 15 by auxiliary means (not shown in more detail) so that spring 14 can not execute any undesired movement of blowing chamber 9 back in the direction of the spinning device. Blowing chamber 9 can be detached in a simple manner from conical seat 16 in the replacement position, e.g., in order to be replaced by a new blowing chamber. This replacement can be performed with advantage by only one operator so that the interruption of production due to replacing the blowing chamber is minimized. At the same time, it is possible to clean the bottom of spinning jet 4 when blowing chamber 9 is removed, since no components of cooling device 2 are in the way to hinder such cleaning operation. Holding device 10 of cooling device 2 can be held stationary during this procedure as previously described. However, it is also possible that holding device 10 may be designed so that it can be adjusted in height and/or rotated relative to spinning device 1.

Figure 3:
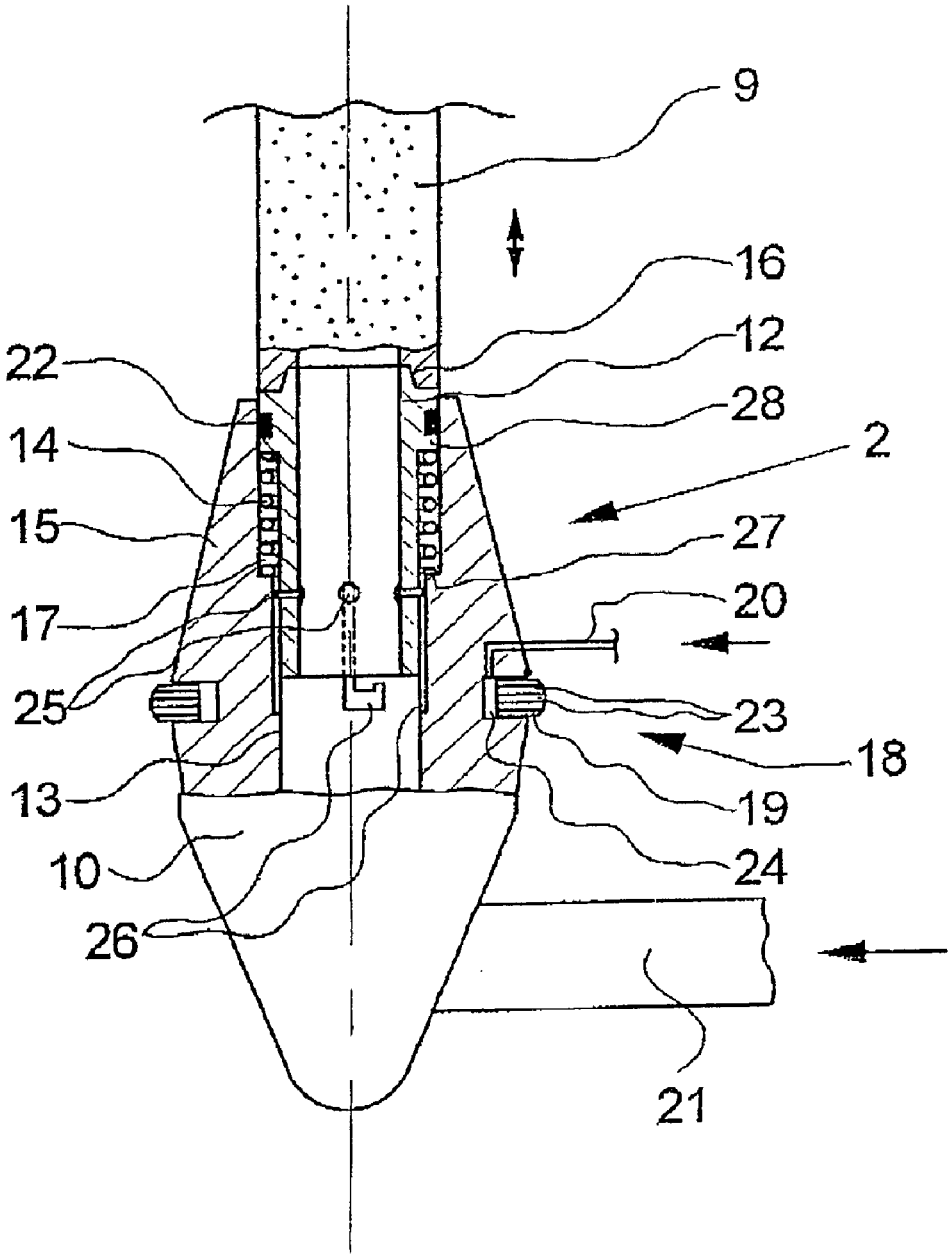
FIGS. 3 and 4 schematically show further exemplary embodiments of cooling devices with a movable blowing chamber.

FIG. 3 shows another exemplary embodiment of a cooling device such as could be used, e.g., in the device of the invention in accordance with FIGS. 1 and 2. The cooling device according to FIG. 3 is substantially identical to the preceding exemplary embodiment so that only the differences will be pointed out in the following description. Holding device 10 comprises receiving element 15 on the end thereof facing blowing chamber 9. Receiving element 15 forms cylindrical centering opening 13 with step 27 thereby forming an lower section of the opening 13 with a smaller diameter and an upper section of the opening 13 with a larger diameter. The free lower end of hollow, cylindrical connection element 12 is inserted into centering opening 13 of receiving element 15. Connection element 12 comprises an enlarged upper circumferential collar 28 forming a lower section of the connection element 12 with a smaller diameter and an upper section of the connection element 12 with a larger diameter. The sections of connection element 12 are guided into the corresponding sections of the receiving opening of receiving element 15. This assembly forms annular space 17 between the section of connection element 12 with the smaller outside diameter and the section of centering opening 13 of receiving element 15 with the larger inside diameter in which annular space spring 14 is arranged to extend between step 27 of receiving element 15 and collar 28 of connection element 12. Several guide elements 25 are provided on the free end of connection element 12 inside receiving element 15. Guide elements 25 are embodied as pins that penetrate the wall of hollow, cylindrical connection element 12 in a radial direction. The free ends of guide pins 25 are guided in corresponding guide grooves 26 formed in centering opening 13 of receiving element 15 to extend in the axial direction of receiving element 15 so that connection element 12 can shift axially. Guide grooves 26 are L-shaped so that a rotation of guide elements 25 by connection element 12 inside connection element 12 is possible in a lowered position of the connection element 12. This design of guide grooves 26 serves the purpose of enabling a locking of connection element 12 in the replacement position of blowing chamber 9.

Blowing chamber 9 is connected via conical seat 16 to the upwardly projecting end of connection element 12.

Holding device 10 carries preparation ring 19 on its circumference, which ring is formed by several ceramic disks 23 stacked relative to each other. Annular collection chamber 24 is formed on the inside of preparation ring 19 and communicates via line 20 with an external preparation source. Thus, a preparation agent is taken up via collection chamber 24 that is conducted outwardly to the filaments via preparation ring 19.

Figure 4:
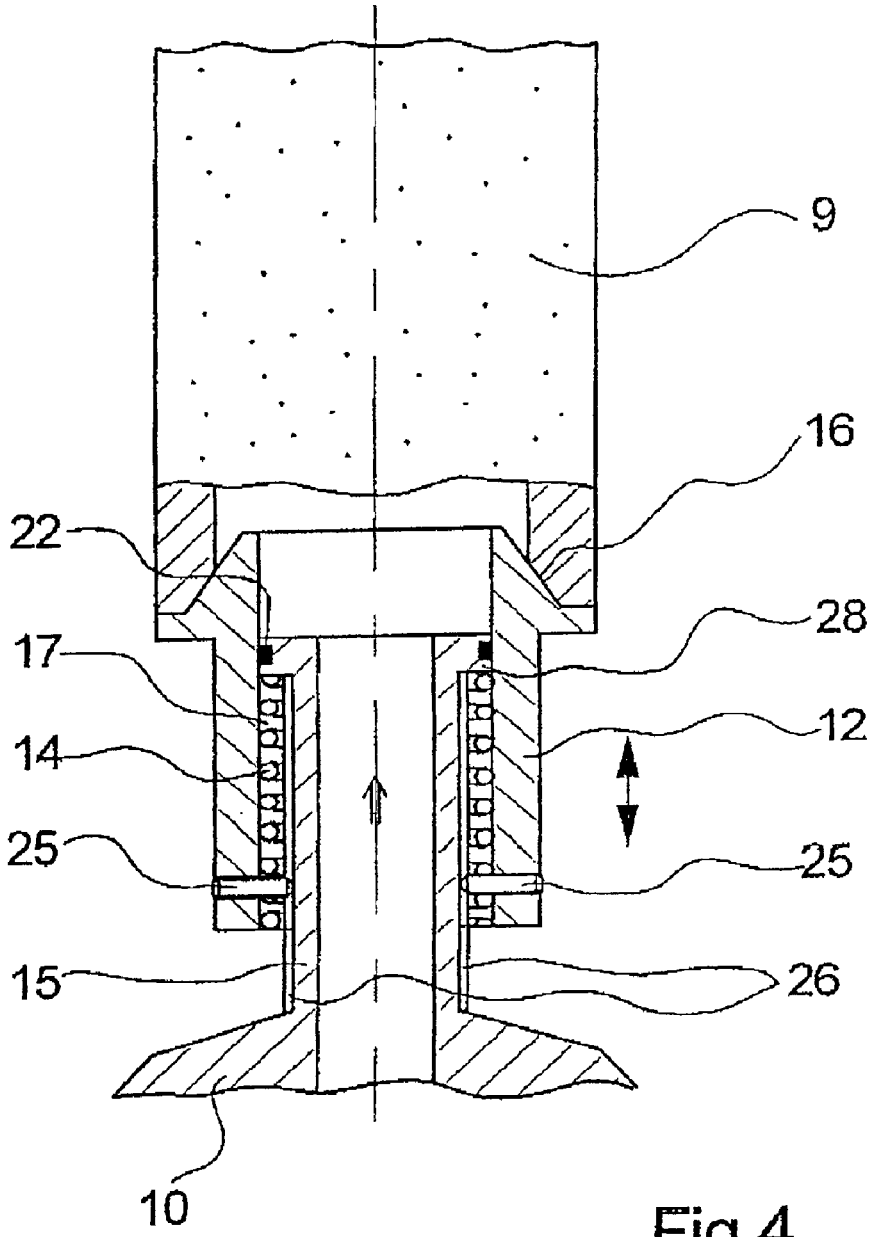

FIG. 4 schematically shows another exemplary embodiment of a cooling device. Hereagain, a section of the cooling device is shown that illustrates the connection between blowing chamber 9 and holding device 10. In this exemplary embodiment, holding device 10 is designed with plug-shaped receiving element 15. Receiving element 15 is a hollow cylinder in order to conduct coolant to blowing chamber 9. Hollow cylindrical connection element 12 is guided on the outer circumference of plug-shaped receiving element 15. To this end, connection element 12 comprises on its free downward end several guide elements 25, such as pins, that penetrate the cylinder wall of connection element 12 and are guided in guide grooves 26 on the circumference of receiving element 15. Collar 28 is formed on the upward free end of receiving element 15 and engages the inside cylindrical wall of connection element 12. Seal 22 is located in collar 28 and prevents escape of the coolant conducted inside the blowing chamber. Spring 14 is provided on the circumference of receiving element 15 between collar 28 and guide elements 25. This spring acts as a tension spring and exerts a biasing force on blowing chamber 9 that acts in an axial direction to spinning device 1. Blowing chamber 9 is connected thereby via conical seat 16 to connection element 12.

In this exemplary embodiment of the cooling device, blowing chamber 9 is thereby also held automatically in an operating position below spinning device 1. This exemplary embodiment could also be used in the device of the invention according to FIGS. 1 and 2.

Blowing chamber 9 may also be pressed in this embodiment downwardly against the biasing force of spring 14 in the direction of holding device 10 and locked, e.g., by rotation of the connection element 12 in order to set the replacement position.

The exemplary embodiments shown in FIGS. 1 to 4 are only examples of representative embodiments of the present invention. The invention extends not only to the exemplary embodiments presented herein but also comprises every cooling device familiar to an person of ordinary skill in the art in which relative movement can be provided between the blowing chamber and the holding device in order to shift the blowing chamber between an operating position and a replacement position.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A device for melt extrusion spinning and cooling of a filament bundle by a spinning device comprising an annular spinning jet and a cooling device arranged below the spinning device, wherein the cooling device comprises a blowing chamber of cylindrical shape extended in the axial direction with a porous annular jacket for directing a coolant stream onto the filament bundle and a holding device for engaging the blowing chamber between the spinning device and the holding device in an operating position of the blowing chamber substantially centrally to the spinning jet, the blowing chamber being displaceable axially relative to the holding device between the operating position and a replacement position.

2. The device according to claim 1, wherein the blowing chamber and the holding device are detachably connected to one another to facilitate replacement of the blowing chamber in the replacement position.

3. The device according to claim 1, wherein a biasing device is operative between the blowing chamber and the holding device for urging the blowing chamber into engagement between the holding device and the spinning device in the operating position.

4. The device according to claim 3, wherein the biasing device comprises a spring operative to exert a displacement force on the blowing chamber in the direction of the spinning device toward the operating position and wherein the spinning device comprises a stop for defining the operating position of the blowing chamber.

5. The device according to claim 3, wherein the biasing device is lockable in the replacement position of the blowing chamber.

6. The device according to claim 1, wherein the blowing chamber is connected at an end thereof facing the holding device to a tubular connection element, the holding device comprises a tubular receiving element for receiving the connection element, and the connection element and the receiving element are connected to one another by insertion of one thereof into the other thereof for relative movement of the connection element and the receiving element.

7. The device according to claim 6, wherein the blowing chamber and the connection element are detachably connected to one another.

8. The device according to claim 6, wherein an annular space is formed between the connection element and the receiving element and that a spring is disposed in the annular space between the connection element and the receiving element.

9. The device according to claim 6, wherein a plurality of guide elements guide shifting, rotating and locking movements of the connection element relative to the receiving element.

10. The device according to claim 1, wherein a preparation device is disposed on the holding device under the blowing chamber, the preparation device comprising a preparation ring for contact by the filament bundle.

11. The device according to claim 10, wherein the preparation ring comprises a plurality of ceramic disks.

12. The device according to claim 1, wherein the holding device is adjustable either or both elevationally and rotationally relative to the spinning device.

* * * * *